US005745158A

United States Patent [19]

Lee

[11] Patent Number: 5,745,158

[45] Date of Patent: Apr. 28, 1998

[54] INDICATION APPARATUS OF PAPER AMOUNT WITHIN A CASSETTE

[75] Inventor: De-Jr Lee, Kweishan, Taiwan

[73] Assignee: Acer Peripherals, Inc., Taoyuan, Taiwan

[21] Appl. No.: 608,288

[22] Filed: Feb. 28, 1996

[51] Int. Cl.[6] ..... B41J 2/47

[52] U.S. Cl. ..... 347/364; 399/23

[58] Field of Search ..... 347/264, 262; 346/134; 399/16, 23

[56] References Cited

U.S. PATENT DOCUMENTS 4,748,479 5/1988 Ohira et al. ..... 399/23

*Primary Examiner*—Mark J. Reinhart
*Attorney, Agent, or Firm*—Meltzer, Lippe, Goldstein et al.

[57] ABSTRACT

An indication apparatus of paper amount within a paper cassette is provided. The paper amount varies due to consumption and has a corresponding variable weight. The cassette has a paper guiding apparatus for positioning the papers and the paper guiding apparatus has a bottom plate touching against a spring force. The cassette has a bottom which has a hook thereon. The indication apparatus comprises a cable having a first end connected to the hook and a second end. A shaft is connected to the cassette for supporting the cable and allowing the cable to slide on a path defined by the shaft. A glider with a predetermined weight is connected to the second end of the cable and has an indicator thereon. A plunger is positioned vertically and engages with the cassette for guiding the movement of the glider. The indicator indicates the amount of papers within the cassette in response to the variable weight of papers within the cassette, the spring force and the predetermined weight of the glider.

2 Claims, 2 Drawing Sheets

INDICATION APPARATUS OF PAPER AMOUNT WITHIN A CASSETTE

TECHNICAL FIELD OF INVENTION

The invention relates to an indication apparatus of paper amount within a paper cassette used in laser printer.

BACKGROUND OF INVENTION

Paper cassette apparatus has been widely used in office automation equipments nowadays, i.e. printer, facsimile machine, xerox machine.

Indication apparatus of paper amount is implemented in the paper cassette to indicate the amount of papers left in the cassette without actually pulling out the cassette from its operation position.

Illustrated in FIG. 1 is one conventional design of indication apparatus of paper amount in accordance with Laserjet IV series of Hewlett Packard Company. As shown, the indication apparatus includes spring 11, 18, stopper 13, lever 15, hinge pin 17, indicator 19, plunger 12 and paper guiding apparatus 14. The numeral 20 represents casing of the cassette.

When paper amount within the cassette is full, the corresponding weight forces the paper guiding apparatus 14 downward to compress the spring 11. At the same time, through the mechanism of lever 15, the indicator 19 is forced to move upward along the plunger 12 to point to a maximum scale.

When paper amount within the cassette is consumed, the spring force 11 gradually extends from its maximum compressed state. This action allows the spring 18 to push the indicator 19 downward to point to a corresponding scale.

This invention provides an alternative approach to indicate the paper amount with the cassette.

SUMMARY OF INVENTION

An indication apparatus of paper amount within a paper cassette is provided. The paper amount varies due to consumption and has a corresponding variable weight.

The cassette has a paper guiding apparatus for positioning the papers and the paper guiding apparatus has a bottom plate touching against a spring force. The cassette has a bottom which has a hook thereon.

The indication apparatus comprises a cable having a first end connected to the hook and a second end. A shaft is connected to the cassette for supporting the cable and allowing the cable to slide on a path defined by the shaft. A glider with a predetermined weight is connected to the second end of the cable and has an indicator thereon.

A plunger is positioned vertically and engages with the cassette for guiding the movement of the glider. The indicator indicates the amount of papers within the cassette in response to the variable weight of papers within the cassette, the spring force and the predetermined weight of the glider.

DETAILED DESCRIPTION OF THE INVENTION

Figure 1:
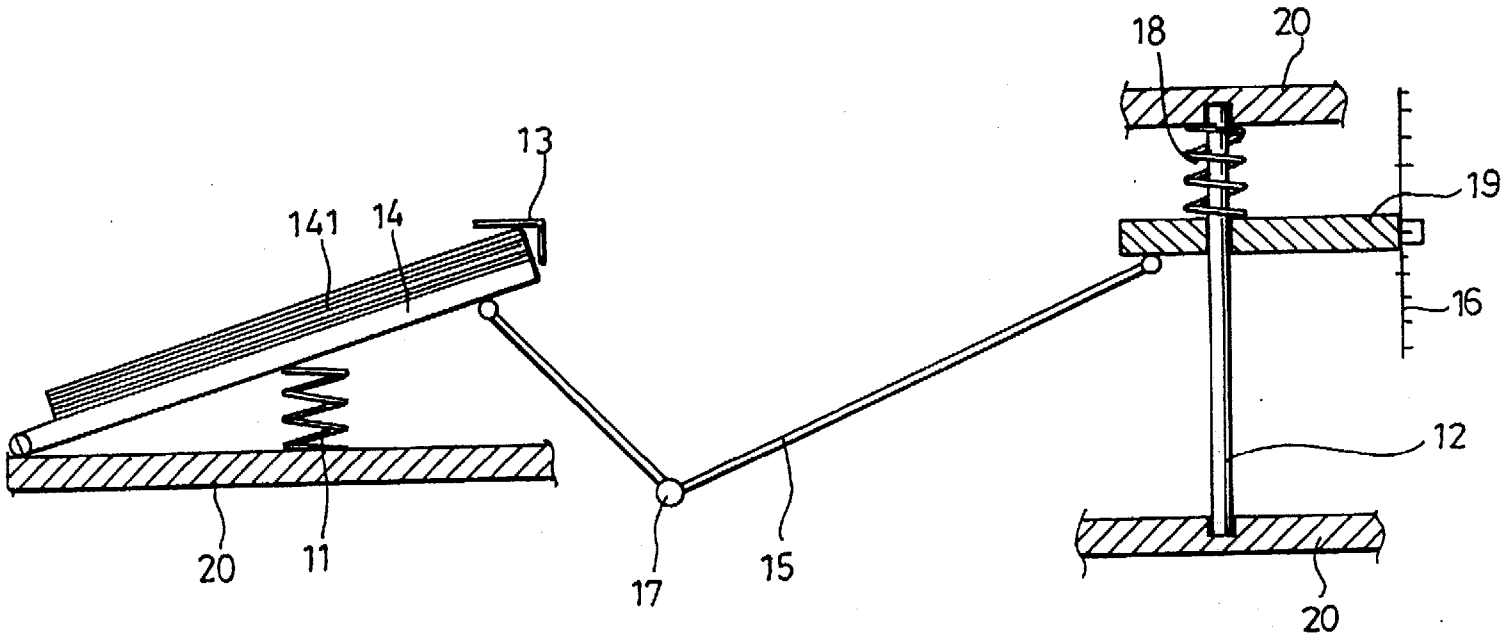
FIG. 1 PRIOR ART
FIG. 1 illustrates one indication apparatus in accordance with the prior art.
Figure 2:
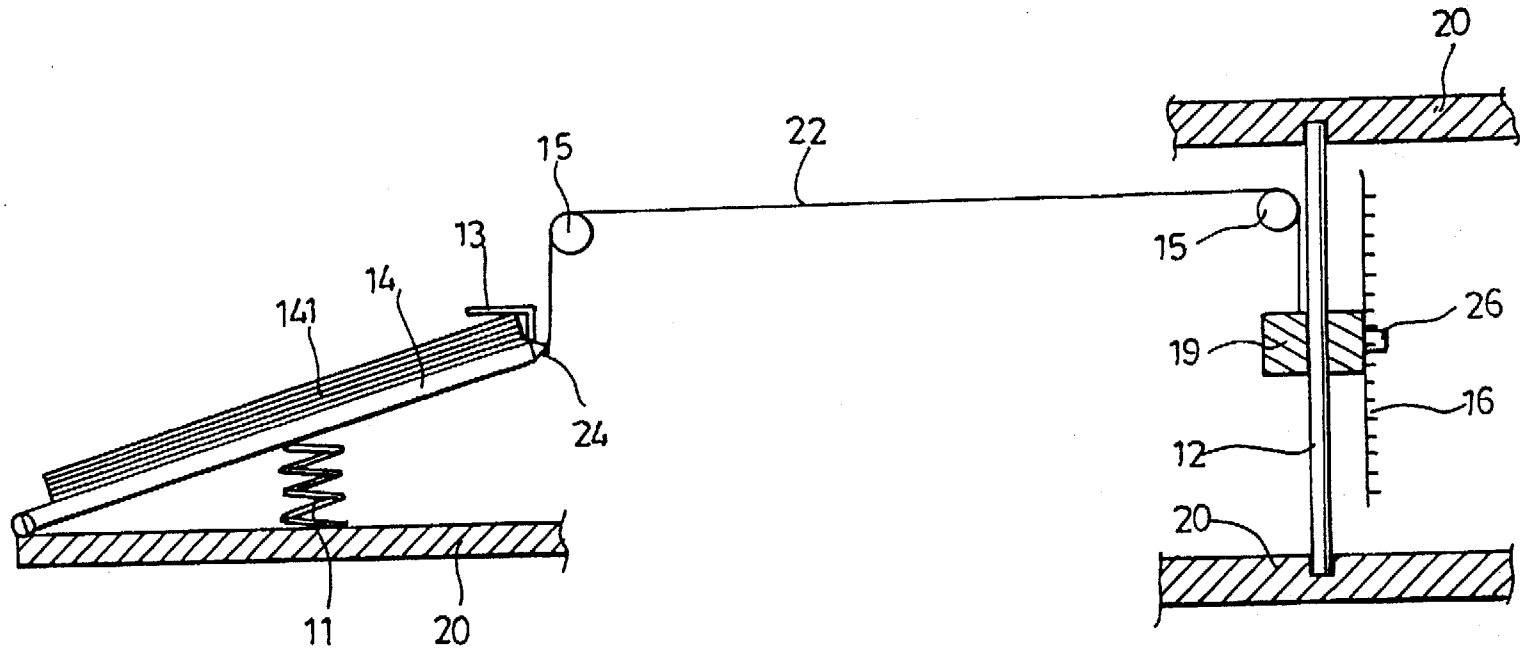
FIG. 2 illustrates the indication apparatus in accordance with the invention.

As indicated in FIG. 2, the indicator 26 indicates the amount of papers 141 within the cassette in response to the variable weight of papers within the cassette, the spring force 11 and the predetermined weight of the glider 19. The paper amount varies due to consumption and has a corresponding variable weight.

The cassette has a paper guiding apparatus 14 for positioning the papers 141 and the paper guiding apparatus 14 has a bottom plate touching against a spring force 11. The cassette has a bottom which has a hook 24 thereon. The indication apparatus comprises a cable 22 having a first end and a second end. The first end is connected to the hook 24. The shafts 15 are connected (not shown) to the casing of the cassette for supporting the cable 22 and allowing the cable 22 to slide on a path defined by the shafts 15. A glider 19 with a predetermined weight is connected to the second end of the cable 22 and has an indicator 26 thereon. A plunger 12 is positioned vertically and engages with the casing 20 of cassette for guiding the vertical movement of the glider 19.

When paper amount within the cassette is full, the. corresponding weight forces the paper guiding apparatus 14 downward to compress the spring 11. At the same time the first end of cable 22 is pulled downward and, in turn, forces the glider 19 moves upward along the plunger 12. The indicator 26 then points to a maximum scale.

When paper amount within the cassette is consumed, the spring force 11 gradually extends from its maximum compressed state. This action allows the weight of glider 19 to pull the second end of cable 22 downward and, in turn, the indicator 26 then points to a corresponding scale.

I claim:

1. An indication apparatus of paper amount within a paper cassette, the paper amount being variable due to consumption and having a corresponding variable weight, the cassette having a paper guiding means for positioning the papers, the paper guiding means having a bottom plate touching against a spring force, the cassette having a bottom which has a hook means thereon, comprising:

a cable having a first end and a second end, the first end being connected to the hook means;

a shaft, connected to the cassette, for supporting the cable and allowing the cable to slide on a path defined by the shaft;

a glider with a predetermined weight, the glider being connected to the second end of the cable, the glider having an indicator thereon;

a plunger, positioned vertically and engaged with the cassette, for guiding the movement of the glider;

wherein, the indicator indicates the amount of papers within the cassette in response to the variable weight of papers within the cassette, the spring force and the predetermined weight of the glider.

2. The apparatus as recited in claim 1, wherein the cable is made of steel material.

* * * * *